428-405 SR
7/24/84 XR 4,461,586

United States Patent [19]

Kawanishi et al.

[11] Patent Number: 4,461,586

[45] Date of Patent: Jul. 24, 1984

[54] INK RIBBON FOR USE IN ELECTROTHERMIC NON-IMPACT RECORDING

[75] Inventors: Toshiyuki Kawanishi; Yukio Tabata, both of Numazu, Japan

[73] Assignee: Ricoh Company, Ltd., Japan

[21] Appl. No.: 379,871

[22] Filed: May 19, 1982

[30] Foreign Application Priority Data

May 20, 1981 [JP] Japan ..... 56-76120
May 20, 1981 [JP] Japan ..... 56-76121
Jun. 5, 1981 [JP] Japan ..... 56-87393

[51] Int. Cl.[3] ..... B41J 3/20; B41J 3/10

[52] U.S. Cl. ..... 400/120; 428/215; 428/408; 428/412; 428/488.1; 428/497; 428/494; 428/518; 428/517; 428/520; 428/321.3; 428/689; 428/532; 428/913; 428/914; 400/191; 400/119; 427/148; 346/135.1

[58] Field of Search ..... 428/408, 215, 518, 520, 428/517, 321.3, 689, 532, 488, 497, 499, 913, 914, 412; 427/148; 400/151; 401/52

[56] References Cited

U.S. PATENT DOCUMENTS 3,330,791 7/1967 Mater et al. ..... 428/321.3
4,163,075 7/1979 Nakano et al. ..... 428/914 X
4,173,677 11/1979 Nakano et al. ..... 427/148 X

FOREIGN PATENT DOCUMENTS 4938629 8/1972 Japan .

*Primary Examiner*—P. Ives
*Attorney, Agent, or Firm*—Guy W. Shoup

[57] ABSTRACT

An ink ribbon for use in electrothermic non-impact recording comprising an electroconductive base layer and an electroconductive thermal-transferable ink layer which are layered. The base layer comprises a binder resin and an electroconductive material dispersed uniformly in the binder resin, while the electroconductive thermal-transferable ink layer comprises a thermoplastic material and an electroconductive material uniformly dispersed in the thermoplastic material, with the surface resistivity $\rho b$ of the base layer being greater than the surface resistivity $\rho i$ of the ink layer, and the softening or melting point Tm1 of the binder resin in the base layer being higher than the softening or melting point Tm2 of the thermoplastic material in the ink layer.

8 Claims, 6 Drawing Figures

FIG. 1
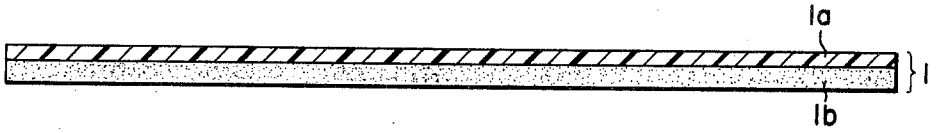
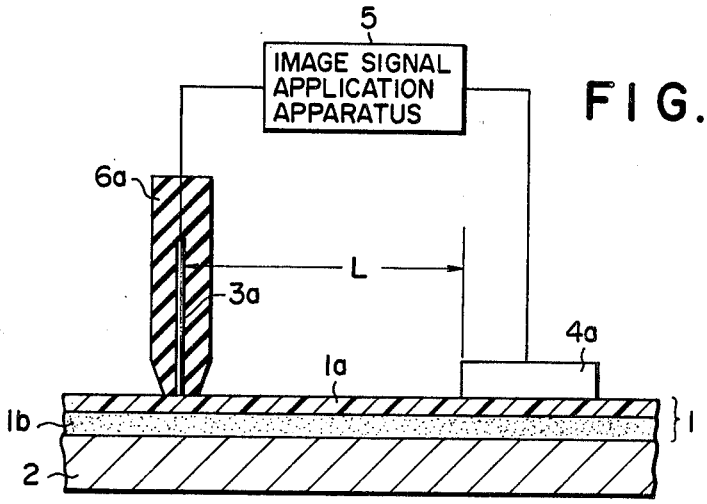
FIG. 2
FIG. 4
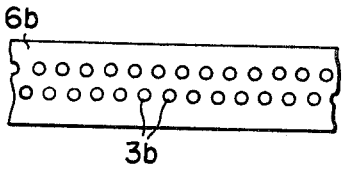
FIG. 3
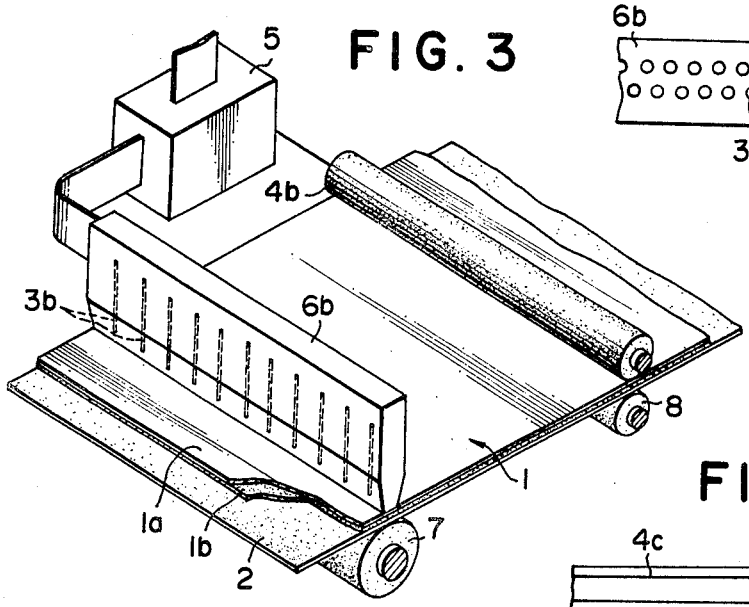
FIG. 5
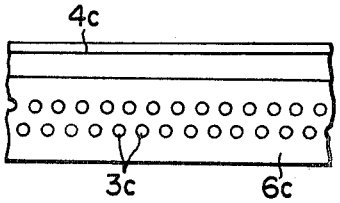

INK RIBBON FOR USE IN ELECTROTHERMIC NON-IMPACT RECORDING

BACKGROUND OF THE INVENTION

The present invention relates to an ink ribbon for use in electrothermic non-impact recording, and more particularly to an ink ribbon comprising an electroconductive base layer and an electroconductive and thermal-transferable ink layer formed on the base layer, wherein the base layer comprises a binder resin and an electroconductive material dispersed in the binder resin, and the ink layer comprises a thermoplastic material and an electroconductive material such as carbon black, in which base layer and ink layer Joule's heat is generated when an image-delineating electric current is caused to flow therethrough, so that the ink layer is softened in an image pattern and can be transferred to a receiving surface, for example, to a sheet of plain paper.

Conventionally, a variety of ink ribbons have been proposed for use in electrothermic non-impact recording in which an ink ribbon containing or coated with a pigmented and thermal-transferable material is superimposed on a sheet of plain paper, and the thermal-transferable material is locally softened in image form in response to image-delineating electric current applied thereto by a recording electrode comprising multiple styli and a return electrode which are placed in contact with the ink ribbon, and the softened thermal-transferable material is then transferred to the plain paper as dots or lines.

For example, in Japanese Laid-Open Patent Application No. 49–38629, there is disclosed an ink ribbon comprising an electrically anisotropic base layer and an electroconductive ink layer. In the electrically anisotropic base layer, the electroconductivity varies with the direction through the base layer—i.e., in this case, the electroconductivity is greater in the transverse direction (normal to the surface) than in the superficial direction (parallel with the surface). This electrically anisotropic base layer is prepared by orienting a ferromagnetic metal powder dispersed in a molten binder resin in the direction normal to the surface of the base layer in a magnetic field. In this method, however, it is extremely difficult to attain uniform orientation of the metal powder over a large area.

In Japanese Laid-Open Patent Application No. 53–7246, there is disclosed another ink ribbon comprising an electrically anisotropic base layer and an electroconductive ink layer. This electrically anisotropic base layer comprises a binder resin and a metal powder dispersed in the binder resin. The most significant shortcoming of this ink ribbon, too, is that the metal powder cannot be dispersed uniformly over a large area, and, if there is a portion where the metal powder is coagulated, the flow of recording electric current becomes uneven in that portion and accurate recording cannot be done.

In Japanese Laid-Open Patent Application No. 56–8276, there is disclosed a further ink ribbon comprising an electrically anisotropic base layer and an electroconductive ink layer. The electrically anisotropic base layer comprises a silicone rubber and minute pin-formed electric conductors made of a metal or carbon embedded in the direction normal to the surface of the layer. The maximum image resolution that can be obtained by this ink ribbon is 4 lines/mm and it is not suitable for practical use.

SUMMARY OF THE INVENTION

It is therefore an object of the present invention to provide an ink ribbon for use in electrothermic non-impact recording capable of obtaining images with high and uniform resolution and image density by small energy consumption, which can be produced without special materials and methods.

According to the present invention, the above object can be attained by an ink ribbon capable of meeting at least the following conditions (1) and (2) with respect to its structure and physical properties:

(1) The ink ribbon comprises an electroconductive base layer and an electroconductive and thermal-transferable ink layer formed on the base layer. The base layer comprises a binder resin and an electroconductive material dispersed uniformly in the binder resin, while the ink layer comprises a thermoplastic material, and an electroconductive material, such as carbon black, dispersed in the thermoplastic material.

(2) The softening point or melting point of the binder resin of the base layer (hereinafter referred to as Tm1) is higher than the softening point or melting point of the thermoplastic material of the ink layer (hereinafter referred to as Tm2). That is, $Tm1 > Tm2$. The surface resistivity $\rho b$ of the base layer is greater than the surface resistivity $\rho i$ of the ink layer. That is $\rho b > \rho i$.

BRIEF DESCRIPTION OF THE DRAWINGS

In the drawings,

FIG. 1 is an enlarged schematic cross section of an ink ribbon according to the present invention.

FIG. 2 is a schematic diagram of an electrothermic non-impact recording apparatus in which an ink ribbon according to the present invention can be employed.

FIG. 3 is a partially cut-away perspective view of another electrothermic non-impact recording apparatus in which an ink ribbon according to the present invention can be employed.

FIG. 4 is a partial bottom view of an example of a recording electrode, particularly showing the arrangement of its recording styli.

FIG. 5 is a partial bottom view of an example of a combination of a recording electrode and a return electrode.

DETAILED DESCRIPTION OF THE PREFERRED EMBODIMENTS

Figure 6:
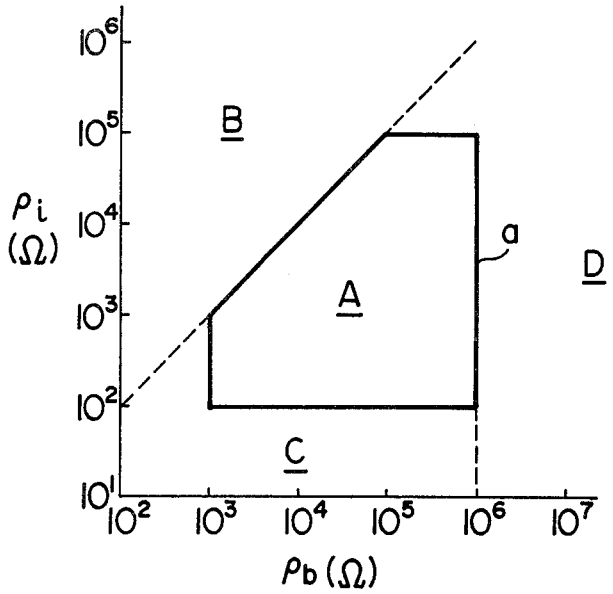
FIG. 6 is a diagram in explanation of the required conditions with respect to the surface resistivities of the base layer and the ink layer of an ink ribbon according to the present invention.

Referring to the accompanying drawings, embodiments of an ink ribbon for use in electrothermic non-impact recording according to the present invention will now be explained.

As shown in FIG. 1, an ink ribbon 1 according to the present invention comprises a base layer 1*a* and an ink layer 1*b* formed on the base layer 1*a*.

The base layer 1*a* comprises a binder resin and an electroconductive material dispersed uniformly in the binder resin. Carbon black is particularly suitable for the electroconductive material in the base layer 1*a*, since it can be uniformly dispersed in the binder resin without difficulty.

As the binder resin for use in the base layer 1*a*, the following resins with a softening point or melting point of 150° C. or higher can be employed:

Polyvinyl butyral; polycarbonate; polystyrene; acrylic resins, such as methylmethacrylate, ethylacrylate and n-butylmethacrylate; polyvinyl chloride resins, such as a vinyl chloride/vinyl acetate copolymer; and celluloses such as ethyl cellulose and acetylcellulose.

As the electroconductive material for use in the base layer 1*a*, carbon black and other organic or inorganic electroconductive powders can be employed.

The ink layer 1*b* comprises a thermoplastic material, preferably a thermoplastic material with a melting point in the range of 50° C. to 200° C., and an electroconductive material dispersed uniformly in the thermoplastic material, which ink layer 1*b* is thermally transferable above a predetermined temperature to a receiving surface, for example, to a sheet of plain paper.

As the thermoplastic material for use in the ink layer 1*b*, the following materials can be employed:

Waxes, such as paraffin wax, polyethylene wax, carnauba waxes; acrylic resins having a low softening point, such as 2-ethylhexyl acrylate and lauryl methacrylate; polyvinyl butyral resin with a low polymerization degree and a low softening point; styrene type resins, such as polystyrene, styrene/acrylic acid copolymer and styrene/butadiene copolymer; oils such as linseed oil; and glycols, such as polyethylene glycol and polypropylene glycol.

As the electroconductive material for use in the ink layer 1*b*, carbon black and metal powders can be employed. In addition, the following colored materials can be employed in the ink layer 1*b*:

Carbon black, phthalocyanine, alkali blue, Spirit Black, Benzidine Yellow, Fast Red, Methyl Red, Crystal Violet, iron oxide and cadmium sulfide. Carbon black can serve as the electroconductive material as well as the colored material in the ink layer 1*b*.

The ink ribbon according to the present invention is prepared by selecting the binder resin for use in the base layer 1*a* and the thermoplastic material for use in the ink layer in such a manner that the softening point or melting point Tm1 of the binder resin is higher than the softening point or melting point Tm2 of the thermoplastic material; that is, $Tm1 > Tm2$.

The base layer 1*a* serves to support the ink layer 1*b* thereon and to strengthen the ink ribbon 1 for practical use. In the base layer 1*a*, and the ink layer 1*b*, specifically immediately below the actuated recording styli of a recording electrode, Joule's heat is generated when an image-delineating electric current is caused to flow through the ink ribbon 1 between the recording electrode and a return electrode, both of which are in contact with the ink ribbon 1, by which Joule's heat the portions of the ink layer immediately below the recording styli are melted and can be transferred to a recording sheet, so that images corresponding to the image-delineating electric current can be formed on the recording sheet.

Referring to FIG. 2, there is schematically shown an example of an electrothermic non-impact recording apparatus in which the ink ribbon 1 according to the present invention can be employed. In the figure, the ink ribbon 1 is superimposed on a recording sheet 2 in close contact therewith.

Above the ink ribbon 1, there is situated a recording electrode 6*a* comprising a plurality of recording styli 3*a* arranged in a row with predetermined spaces therebetween. The lower portion of each recording stylus 3*a* is in contact with the surface of the ink ribbon 1. Further, there is disposed a return electrode 4*a*, substantially parallel to the row of recording styli 3*a*, at a distance L from the row of recording styli 3*a*. The return electrode 4*a* is also in contact with the surface of the ink ribbon 1 with a contact area with the ink ribbon 1 at least five times greater than the total contact area with the ink ribbon 1 of the recording styli 3*a*.

An image signal application apparatus 5 is connected to the recording electrode 6*a* and the return electrode 4*a*.

When image-delineating signals are applied between the one or more selected recording styli 3*a* and the return electrode 4*a*, the corresponding image-delineating current flows through the base layer 1*a* of the ink ribbon 1. Since the contact area with the ink ribbon 1 of the return electrode 4*a* is significantly greater (at least five times greater) than the total contact area with the ink ribbon 1 of the recording styli 3*a*, and, of course, greater than the contact area with the ink ribbon 1 of each recording stylus 3*a*, and since the same amount of electric current flows through the recording styli 3*a* as through the return electrode 4*a*, the current density in the portion of the ink ribbon 1 immediately below each recording stylus 3*a* is extremely greater than the current density in the portion of the ink ribbon 1 immediately below the return electrode 4*a*. Therefore, in comparison with the Joule's heat generated in the ink ribbon 1 below the return electrode 4*a*, an extremely great amount of the Joule's heat is generated in the ink ribbon 1 below the recording styli 3*a*. As a result, by selection of thermal-transferable ink with an appropriate melting point, and by supplying an appropriate amount of electric current, only the thermal-transferable ink material present in the ink layer 1*b* immediately below the recording styli 3*a* is melted by the Joule's heat and is then transferred to the recording sheet 2.

In the ink ribbon according to the present invention, it is preferable that the softening point or melting point of the binder resin of the base layer, Tm1, and the softening point or melting point of the thermoplastic material of the ink layer, Tm2, meet the following conditions:

$$Tm1 > 150° C., 50° C. \leqq Tm2 \leqq 200° C., \text{ and } Tm1 > Tm2.$$

It is necessary that the binder resin of the base layer 1*a* have the ability to be formed into film.

The experiments with respect to a variety of synthetic resins and natural resins, conducted by the inventors of the present invention, indicated that resins having film-formation capability, when nothing is added to the resins, and which have softening or melting points Tm1 of about 100° C., will lose strength and cannot be used practically when an electroconductive material, such as carbon black, is added thereto. In contrast to this, when $Tm1 > 150°$ C., the strength of the film is not decreased when such electroconductive material is added, and the film can be used practically.

With respect to the thermoplastic material employed in the ink layer 1*b*, when Tm2 is lower than 50° C., the ink layer 1*b* is easily transferred to the recording sheet 2 by application of slight pressure thereto, smearing the background of the recording sheet 2. On the other hand, as Tm2 increases, more energy is required for recording. In order to keep the required recording energy at not more than 10 mJ, which is suitable for practical use, it is necessary that Tm2 be not higher than 200° C.; that is, $Tm2 \leqq 200°$ C.

Furthermore, it is preferable that, if the thickness of the base layer 1*a* is $l_1$ and the thickness of the ink layer 1*b* is $l_2$, the following conditions be met:

$$0.5\ \mu m \leqq l_1 \leqq 20\ \mu m,$$

$$1\ \mu m \leqq l_2 \leqq 25\ \mu m, \text{ and}$$

$$1.5\ \mu m \leqq l_1 + l_2 \leqq 30\ \mu m.$$

Since the thermoplastic material contained in the ink layer 1*b* also serves to strengthen the ink ribbon 1, if $l_1+l_2 \geqq 1.5\ \mu m$, the strength of the ink ribbon 1 is sufficient for practical use even if $l_1$ is approximately 0.5 μm. When $l_2<1\ \mu m$, the density of the recorded dots formed on the recording sheet 2 becomes too low for practical use. On the other hand, when $l_1>20\ \mu m$, $l_2>25\ \mu m$, and $l_1+l_2>30\ \mu m$, power consumed other than for recording is significantly increased.

Furthermore, it is preferable that the surface resistivity ρb of the base layer 1*a* and the surface resistivity ρi of the ink layer 1*b* meet the following conditions:

$$1\times10^3\Omega \leqq \rho b \leqq 1\times10^6\Omega,$$

$$1\times10^2\Omega \leqq \rho i \leqq 1\times10^5\Omega,$$

$$\text{and } \rho b > \rho i$$

In FIG. 6, an area A enclosed by a solid line a meets the above conditions with respect to the surface resistivity ρb of the base layer 1*a* and the surface resistivity ρi of the ink layer 1*b*.

In an area B, since ρb<ρi, a greater amount of electric current flows through the base layer 1*a* than through the ink layer 1*b*, so that more Joule's heat is generated in the base layer 1*a* than in the ink layer 1*b*. The result is that heat generated in the base layer 1*a* is transferred to the ink layer 1*b*, and the melted ink layer 1*b* is transferred to a sheet of paper. In the case where heat is transferred from the base layer 1*a* to the ink layer 1*b*, the diffusion of heat towards the ink layer 1*b* is inevitable and, therefore, high image resolution cannot be obtained. Furthermore, in this case, since electric current flows through the base layer 1*a* in the superficial direction thereof, greater energy is required for recording than in the case defined by the previously described area A.

In an area C, since the surface resistivity ρb of the ink layer 1*b* is small, a great amount of electric current flows through the ink layer 1*b*. However, in the area C, when a plurality of recording styli is actuated at the same time, too much total current flows through the ink layer 1*b*.

In an area D, since the surface resistivity ρb of the base layer 1*a* is great, high voltage has to be applied across the ink ribbon for recording.

As shown in FIG. 2, in the electrothermic non-impact recording apparatus, it is necessary that the distance L between the recording styli 3*a* and the return electrode 4*a* conform to the relationship of $l_1<1/5$ L. This is because, in the ink ribbon 1 according to the present invention, an electrically anisotropic base layer is not employed and, therefore, it is necessary that the image-delineating current not spread much in the superficial direction, in order that it may form images faithful to the image-delineating current applied thereto and reduce energy consumption. It is preferable that $l_1$ be smaller than 1/10 L, that is, $l_1<1/10$ L. In this case, dots accurately corresponding to the image-delineating current applied to the recording electrodes 3*a* can be formed.

When $l_1 \geqq 1/5$ L, extremely large dots are formed under the recording styli 3*a* and accordingly the power consumption is great.

In an embodiment of an ink ribbon according to the present invention, the base layer 1*a* comprises polycarbonate and carbon black dispersed uniformly in the polycarbonate, and, in another embodiment, the base layer 1*a* comprises polyvinyl butyral and carbon black, while the ink layer 1*b* comprises a thermoplastic material, such as wax, with a softening or melting point ranging from 50° C. to 200° C. and carbon black dispersed in the thermoplastic material. The carbon black serves as an electroconductive material as well as a colored material in the ink layer 1*b*.

Referring to FIG. 3, there is shown a partially cutaway perspective view of another electrothermic non-impact recording apparatus to which the above-described embodiments of an ink ribbon according to the present invention can be applied.

In the figure, reference numeral 6*b* represents a recording electrode which comprises multiple recording styli 3*b* arranged in a row with predetermined spaces therebetween. The recording styli 3*b* are arranged substantially parallel to a return electrode 4*b*. Reference numeral 5 represents an image signal application apparatus which is connected to the recording electrode 6*b* and the return electrode 4*b*. As shown in the figure, the return electrode 4*b* is formed in the shape of a roller so as to be rotatable, thus capable of serving as a transport member for transporting the ink ribbon 1 and the recording sheet 2, in combination with a support member 8 disposed under the return electrode 4*b*. Under the recording styli 3*b*, there is also disposed a support member 7, in such a manner as to hold and transport the superimposed ink ribbon 1 and recording sheet 2 therebetween.

For obtaining high image resolution with less power consumption, it is preferable that the recording styli 3*b* and the return electrode 4*b* be arranged in accordance with the following relationship:

$$2\times d \leqq Lm \leqq 200\times d$$

where d represents the diameter of each recording stylus 3*b*, and Lm represents the distance between each recording stylus 3*b* and the return electrode 4*b*, with the total contact area with the ink ribbon 1 of the styli 3*b* being one-fifth or less of the contact area with the ink ribbon 1 of the return electrode 4*b*.

When $Lm<2\times d$, the thermal-transferable material in the ink layer 1*b* along the distance between the recording styli 3*b* and the return electrode 4*b* is melted and transferred, so that the image resolution is significantly reduced.

On the other hand, when $Lm>200\times d$, the electric energy consumed in the electric path between the recording styli 3*b* and the return electrode 4*b* increases to a degree that cannot be ignored, in comparison with the energy consumed in the recording styli 3*b*, resulting in generation of insufficient Joule's heat in the ink ribbon 1 below the styli 4*b* for practical use or adequate speed. The above-described relationship applies to the electrothermic non-impact recording apparatus shown in FIG. 1.

The recording styli 3b can be arranged zig-zag in two rows as shown in FIG. 4. As a matter of course, they also can be arranged zig-zag in more than two rows, so as to cover the spaces therebetween as much as possible.

FIG. 5 shows a combination of a recording electrode 6c and a return electrode 4c, which are formed in one piece by connecting them to each other by an electrically insulating frame member.

Specific embodiments of an ink ribbon according to the present invention will now be explained.

The embodiments were subjected to the following dot-formation tests in order to investigate the image formation performance of each embodiment by use of the electrothermic non-impact recording apparatus as shown in FIG. 3. In these tests, the diameter of each recording stylus 3b was 130 μm and the recording styli 3b were arranged in two rows as shown in FIG. 4, with a stylus density being approximately 8 styli per mm. The distance between the recording styli 3b and the return electrode was 1 mm and a pulse voltage of 100 V with a pulse width of 1 msec was applied between the recording electrode 6b and the return electrode 4b.

EXAMPLE 1

A base layer with a thickness of 12 μm and with a surface resistivity ρb of 30 KΩ was prepared by mixing 70 wt. % of polyvinyl butyral with a softening point of 200° C. and 30 wt. % of carbon black. An ink layer with a thickness of 5 μm and a surface resistivity ρi of 5 KΩ was formed on the base layer by mixing 60 wt. % of paraffin wax with a melting point of 60° C. and 40 wt. % of carbon black, whereby an ink ribbon No. 1 according to the present invention was prepared. The thus prepared ink ribbon No. 1 was subjected to the above-described dot-formation test.

The result was that a circular dot with a diameter of approximately 150 μm was formed immediately below each stylus. 1.0 mJ of recording energy was required for the formation of each dot. The recorded dot density was approximately 8 dots/mm.

The ink ribbon was neither wrinkled nor torn during the above test.

EXAMPLE 2

A base layer with a thickness of 15 μm and with a surface resistivity ρb of 30 KΩ was prepared by mixing 70 wt. % of polyvinyl butyral with a softening point of 160° C. and 30 wt. % of carbon black. An ink layer with a thickness of 3 μm and a surface resistivity ρi of 7 KΩ was formed on the base layer by mixing 60 wt. % of Carnauba was with a melting point of 80° C. and 40 wt. % of carbon black, whereby an ink ribbon No. 2 according to the present invention was prepared. The thus prepared ink ribbon No. 2 was subjected to the same dot-formation test as that in Example 1.

The result was that a circular dot with a diameter of approximately 150 μm was formed immediately below each stylus. 1.5 mJ of recording energy was required for the formation of each dot. The recorded dot density was approximately 8 dots/mm.

The ink ribbon was neither wrinkled nor torn during the above test.

EXAMPLE 3

A base layer with a thickness of 10 μm and with a surface resistivity ρb of 120 KΩ was prepared by mixing 80 wt. % of polyvinyl butyral with a softening point of 230° C. and 20 wt. % of carbon black. An ink layer with a thickness of 3 μm and a surface resistivity ρi of 20 KΩ was formed on the base layer by mixing 60 wt. % of polyethylene wax with a melting point of 110° C. and 40 wt. % of carbon black, whereby an ink ribbon No. 3 according to the present invention was prepared. The thus prepared ink ribbon No. 3 was subjected to the same dot-formation test as that in Example 1.

The result was that a circular dot with a diameter of approximately 150 μm was formed immediately below each stylus. 2.5 mJ of recording energy was required for the formation of each dot. The recorded dot density was approximately 8 dots/mm.

The ink ribbon was neither wrinkled nor torn during the above test.

EXAMPLE 4

A base layer with a thickness of 10 μm and with a surface resistivity ρb of 20 KΩ was prepared by mixing 93 wt. % of polycarbonate with a softening point of 230° C. and 7 wt. % of carbon black. An ink layer with a thickness of 5 μm and a surface resistivity ρi of 5 KΩ by was formed on the base layer by mixing 60 wt. % of paraffin wax with a melting point of 60° C. and 40 wt. % of carbon black, whereby an ink ribbon No. 4 according to the present invention was prepared. The thus prepared ink ribbon No. 4 was subjected to the same dot-formation test as that in Example 1.

The result was that a circular dot with a diameter of approximately 150 μm was formed immediately below each stylus. 1.5 mJ of recording energy was required for the formation of each dot. The recorded dot density was approximately 8 dots/mm.

This ink ribbon was neither wrinkled nor torn during the above test.

EXAMPLE 5

A base layer with a thickness of 7 μm and with a surface resistivity ρb of 50 KΩ was prepared by mixing 95 wt. % of polycarbonate with a softening point of 230° C. and 5 wt. % of carbon black. An ink layer with a thickness of 5 μm and a surface resistivity ρi of 7 KΩ by was formed on the base layer by mixing 60 wt. % of Carnauba wax with a melting point of 80° C. and 40 wt. % of carbon black, whereby an ink ribbon No. 5 according to the present invention was prepared. The thus prepared ink ribbon No. 5 was subjected to the same dot-formation test as that in Example 1.

The result was that a circular dot with a diameter of approximately 150 μm was formed immediately below each stylus. 2.5 mJ of recording energy was required for the formation of each dot. The recorded dot density was approximately 8 dots/mm.

This ink ribbon was neither wrinkled nor torn during the above test.

EXAMPLE 6

A base layer with a thickness of 5 μm and with a surface resistivity ρb of 110 KΩ was prepared by mixing 97 wt. % of polycarbonate with a softening point of 230° C. and 3 wt. % of carbon black. An ink layer with a thickness of 5 μm and a surface resistivity ρi of 20 KΩ by was formed on the base layer by mixing 60 wt. % of polyethylene wax with a melting point of 110° C. and 40 wt. % of carbon black, whereby an ink ribbon No. 6 according to the present invention was prepared. The thus prepared ink ribbon No. 6 was subjected to the same dot-formation test as that in Example 1.

The result was that a circular dot with a diameter of approximately 150 μm was formed immediately below each stylus. 2.0 mJ of recording energy was required for the formation of each dot, and the recorded dot density was approximately 8 dots/mm.

This ink ribbon was neither wrinkled nor torn during the above test.

COMPARATIVE EXAMPLE 1

A comparative ink ribbon No. 1 consisting of a single layer with a thickness of 15 μm and with a surface resistivity of 3 KΩ was prepared by mixing 50 wt. % of polyvinyl butyral with a softening point of 200° C. and 50 wt. % of carbon black. The thus prepared comparative ink ribbon No. 1 was subjected to the same dot-formation test as that in Example 1.

The result was that a circular dot with a diameter of approximately 150 μm was formed immediately below each stylus. The recording energy required for the formation of each dot was 3.5 mJ. The recorded dot density was approximately 8 dots/mm.

The ink ribbon was not torn, but was wrinkled during the above test.

COMPARATIVE EXAMPLE 2

A comparative ink ribbon No. 2 consisting of a single layer with a thickness of 12 μm and with a surface resistivity of 10 KΩ was prepared by mixing 90 wt. % of polycarbonate with a softening point of 230° C. and 10 wt. % of carbon black. The thus prepared comparative ink ribbon No. 2 was subjected to the same dot-formation test as that in Example 1.

The result was that a circular dot with a diameter of approximately 150 μm was formed immediately below each stylus. The recording energy required for the formation of each dot was 10.0 mJ. The recorded dot density was approximately 8 dots/mm.

This ink ribbon was neither wrinkled nor torn during the above test.

What is claimed is:

1. An ink ribbon for use in electrothermic non-impact recording employing a stylus and return electrode comprising:

an electroconductive base layer with which the stylus comes into contact comprising a binder resin and an electroconductive material dispersed uniformly in said binder resin, the surface resistivity $\rho b$ of said base layer ranging from $1\times10^3$ ohms to $1\times10^6$ ohms, and an electroconductive ink layer comprising a thermoplastic material and an electroconductive material uniformly dispersed in said thermoplastic material, said ink layer directly formed on said base layer, said ink layer being thermal-transferable when heated by Joules heat above a predetermined temperature, the surface resistivity $\rho i$ of said ink layer ranging from $1\times10^2$ ohms to $1\times10^5$ ohms, with said surface resistivity $\rho b$ of said base layer being greater than the surface resistivity $\rho i$ of said ink layer, and with the softening or melting point (Tm1) of said binder resin of said base layer being higher than the softening or melting point (Tm2) of said thermoplastic material of said ink layer.

2. An ink ribbon as claimed in claim 1, wherein said binder resin in said electroconductive base layer is a member selected from the group consisting of polyvinyl butyral, polycarbonate, polystyrene, acrylic resins, polyvinyl chloride resins and celluloses.

3. An ink ribbon as claimed in claim 1, wherein said electroconductive material in said electroconductive base layer is carbon black.

4. An ink ribbon as claimed in claim 1, wherein said thermoplastic material in said electroconductive ink layer is a member selected from the group consisting of waxes, acrylic resins, polyvinyl butyral resin, styrene type resins, oils and glycols.

5. An ink ribbon as claimed in claim 1, wherein said electroconductive material in said electroconductive ink layer is carbon black.

6. An ink ribbon as claimed in claim 1, wherein said electroconductive ink layer further comprising a colored member selected from the group consisting of carbon black, phthalocyanine, alkali blue, Spirit Black, Benzidine Yellow, Fast Red, Methyl Red, Crystal Violet, iron oxide and cadmium sulfide.

7. An ink ribbon as claimed in claim 1, wherein said $Tm1 > 150°$ C., and $50°$ C. $\leqq Tm2 \leqq 200°$ C.

8. An ink ribbon as claimed in claim 1, wherein and the thickness $l_1$ of said base layer and the thickness $l_2$ of said ink layer are in the relationship of $$0.5\ \mu m \leqq l_1 \leqq 20\ \mu m,$$

$$1\ \mu m \leqq l_2 \leqq 25\ \mu m, \text{ and}$$

$$1.5\ \mu m \leqq l_1 + l_2 \leqq 30\ \mu m.$$

* * * * *